US011835244B2

(12) United States Patent
Lord et al.

(10) Patent No.: US 11,835,244 B2
(45) Date of Patent: Dec. 5, 2023

(54) EVAPORATOR WITH ONE OR MORE LEAK MITIGATION DAMPERS

(71) Applicant: CARRIER CORPORATION, Palm Beach Gardens, FL (US)

(72) Inventors: Richard G. Lord, Murfreesboro, TN (US); Larry D. Burns, Avon, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 11 days.

(21) Appl. No.: 17/253,246

(22) PCT Filed: Sep. 10, 2020

(86) PCT No.: PCT/US2020/050034
§ 371 (c)(1),
(2) Date: Dec. 17, 2020

(87) PCT Pub. No.: WO2021/050617
PCT Pub. Date: Mar. 18, 2021

(65) Prior Publication Data

US 2022/0307711 A1 Sep. 29, 2022

Related U.S. Application Data

(60) Provisional application No. 62/900,082, filed on Sep. 13, 2019.

(51) Int. Cl.
*F24F 11/36* (2018.01)
*F24F 13/10* (2006.01)
(Continued)

(52) U.S. Cl.
CPC ..... *F24F 11/36* (2018.01); *F24F 13/10* (2013.01); *F25B 49/005* (2013.01); *F24F 2013/146* (2013.01); *F25B 2500/222* (2013.01)

(58) Field of Classification Search
CPC ..... F24F 11/36; F24F 13/10; F24F 2013/146; F25B 49/005; F25B 2500/222
See application file for complete search history.

(56) References Cited

U.S. PATENT DOCUMENTS 5,918,475 A * 7/1999 Sakakibara ..... B60H 1/3225 62/126
2016/0363358 A1 12/2016 Papas et al.
(Continued)

FOREIGN PATENT DOCUMENTS

JP H08200904 A 8/1996

OTHER PUBLICATIONS

JP 08200904 (English translation) (Year: 1996).*
ISR/WO; PCT/US2020/050034; dated Dec. 21, 2020; 13 pages.

*Primary Examiner* — Jonathan Bradford
(74) *Attorney, Agent, or Firm* — CANTOR COLBURN LLP

(57) ABSTRACT

An HVAC/R system having: an HVAC/R component that has a heat exchanger, the HVAC/R component configured to allow a refrigerant to flow therethrough; a housing with the heat exchanger disposed there therein, and a supply side air conduit connected to the housing, the supply side air conduit being operably coupled to the HVAC/R component; a supply side leak mitigation damper operably coupled to the supply side air conduit; and wherein the supply side leak mitigation conduit is configured to selectively block airflow through the supply side air conduit.

5 Claims, 3 Drawing Sheets

(51) Int. Cl.
*F25B 49/00* (2006.01)
*F24F 13/14* (2006.01)

(56) References Cited

U.S. PATENT DOCUMENTS

| | | | | |
|---|---|---|---|---|
| 2018/0259235 | A1 | 9/2018 | Delgoshaei | |
| 2018/0321121 | A1 | 11/2018 | Rydkin et al. | |
| 2019/0170604 | A1 | 6/2019 | Kester | |
| 2020/0056820 | A1* | 2/2020 | Suzuki | F25B 49/005 |

* cited by examiner

EVAPORATOR WITH ONE OR MORE LEAK MITIGATION DAMPERS

CROSS REFERENCE TO RELATED APPLICATIONS

This application is a Non-Provisional Application of PCT/US2020/050034 filed Sep. 10, 2020, which claims the benefit of U.S. Application No. 62/900,082 filed Sep. 13, 2019, the disclosure of which is incorporated herein by reference in its entirety.

BACKGROUND

The presently disclosed embodiments generally relate to heating, ventilation, air conditioning, and refrigeration (HVAC) systems, and more particularly, to an evaporator section of the unit with one or more leak mitigation dampers.

Refrigeration systems, as used in HVAC applications, utilize a closed loop refrigerant circuit to condition air inside an interior building space. Over the years, the HVAC industry has been using refrigerants with high global warming impact such as hydrochlorofluorocarbons (HCFCs); and hydrofluorocarbon refrigerant (HFC) however, the use of GWP depleting refrigerants is currently being phased out due to the negative impact on the environment.

New refrigerants have been developed to comply with environmental regulations relating to global warming potential (GWP). In order to comply with the proposed GWP regulations, hydrofluorocarbon (HFC) and Hydrofluro-Olefins (HFO) which many are mildly flammable A2L refrigerant and are being developed and are being considered for use in HVAC systems.

As with any system, there is a potential for refrigerants used in HVAC applications to leak and migrate to undesirable areas in the vicinity of the HVAC system and into the building. If mildly flammable refrigerants are being used and with the mildly flammable refrigerants, is in the presence of air or another oxidizer, and are exposed to an a competent ignition source, the potential for a combustion event exists if the mixture is above the lower flammability limit (LFL) and below the upper flammability limit (UFL).

SUMMARY OF THE DISCLOSED EMBODIMENTS

Disclosed is a HVAC/R system including: an HVAC/R component that includes a fan coil, the HVAC/R component configured to allow a refrigerant to flow therethrough; a housing with the fan coil disposed there therein, and a supply side air conduit connected to the housing, the supply side air conduit being operably coupled to the HVAC/R component; a supply side leak mitigation damper operably coupled to the supply side air conduit; and wherein the supply side leak mitigation conduit is configured to selectively block airflow through the supply side air conduit.

In addition to one or more of the above disclosed aspects or as an alternate the system includes a return side air conduit connected to the housing, the return side air conduit being operably coupled to the HVAC/R component; a return side leak mitigation damper operably coupled to the return side air conduit; and wherein the return side leak mitigation conduit is configured to selectively block airflow through the return side air conduit when the supply side leak mitigation damper selectively blocks airflow through the supply side air conduit.

In addition to one or more of the above disclosed aspects or as an alternate the system includes a refrigerant sensor within the housing.

In addition to one or more of the above disclosed aspects or as an alternate the system includes a controller in electrical communication with the sensor.

In addition to one or more of the above disclosed aspects or as an alternate the HVAC/R component further includes a fan motor in electrical communication with the controller.

In addition to one or more of the above disclosed aspects or as an alternate the supply side leak mitigation damper includes a rotating component that connects the supply side leak mitigation damper to the supply side air conduit.

In addition to one or more of the above disclosed aspects or as an alternate the supply side leak mitigation damper includes a damper member connected to the rotating component.

In addition to one or more of the above disclosed aspects or as an alternate the rotating component is actuated by a counterbalance.

In addition to one or more of the above disclosed aspects or as an alternate the rotating component is spring actuated.

In addition to one or more of the above disclosed aspects or as an alternate the fan coil is operably coupled to a furnace.

In addition to one or more of the above disclosed aspects or as an alternate the HVAC/R component includes a fan coil.

In addition to one or more of the above disclosed aspects or as an alternate the HVAC/R component includes a refrigeration unit.

Further disclosed is a method of diluting a leaked refrigerant in an HVAC/R system, the system including an HVAC/R component that includes a fan coil, the HVAC/R component operably coupled to a plurality of air conduits with the fan coil disposed therebetween, and a supply side leak mitigation damper operably coupled to a supply side air conduit, the method includes: determining that a refrigerant leak has occurred; activating a fan of the fan coil; and opening the supply side leak mitigation damper.

In addition to one or more of the above disclosed aspects or as an alternate the supply side leak mitigation damper is biased closed when the fan is inactive by springs and/or counterweights.

In addition to one or more of the above disclosed aspects or as an alternate fan airflow opens the supply side leak mitigation damper.

In addition to one or more of the above disclosed aspects or as an alternate a sensor is disposed adjacent to the fan coil, and determining whether a refrigerant leak has occurred includes operating the sensor to detect a leak.

Further disclosed is a HVAC/R system includes: an HVAC/R component that includes a fan coil, the HVAC/R component configured to allow a refrigerant to flow therethrough; a plurality of air conduits operably coupled to the HVAC/R component with the fan coil therebetween, including a supply side air conduit; a sensor configured to detect a refrigerant leak; and a supply side leak mitigation damper, the supply side leak mitigation damper configured to move from an opened position to a closed position, wherein: when the supply side leak mitigation damper is in the opened position, the supply side air conduit is unblocked; and when a refrigerant leak is detected, the supply side leak mitigation damper is rotated to the opened position.

In addition to one or more of the above disclosed aspects or as an alternate when a fan of the fan coil is deactivated the supply side leak mitigation damper is biased to the opened position.

In addition to one or more of the above disclosed aspects or as an alternate the supply side leak mitigation damper includes a rotating component that connects a damper member to the supply side air conduit.

In addition to one or more of the above disclosed aspects or as an alternate the rotating component is biased closed by a spring or a counterbalance.

BRIEF DESCRIPTION OF DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
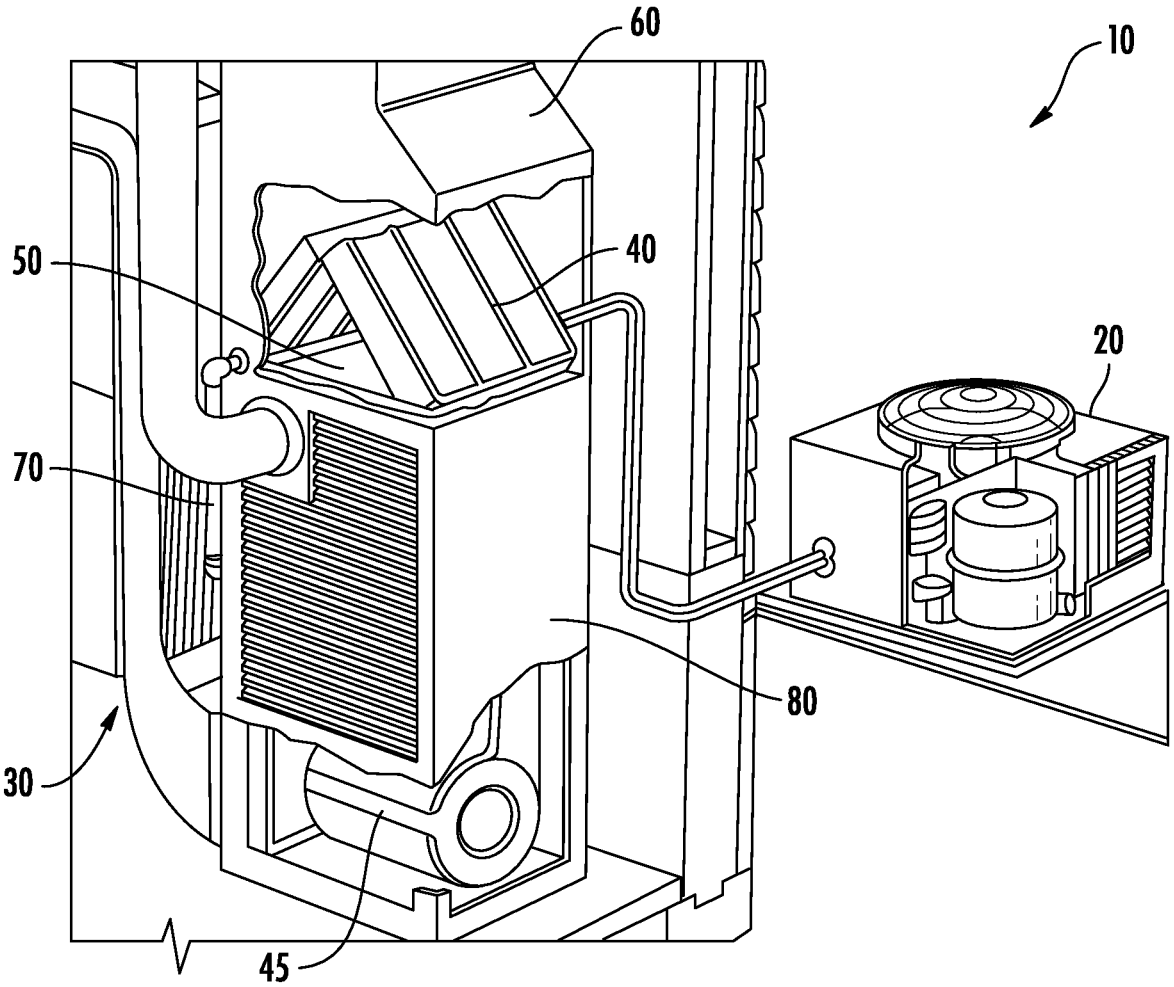
FIG. 1 is a schematic diagram of an HVAC fan coil system which may utilize features of the disclosed embodiments.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an air conditioning (AC) system 10. The configuration of FIG. 1 can be used in a number of applications, such as in residential systems. When used with a residential system, the system 10 includes an outdoor HVAC assembly 20 which may include a compressor. The outdoor HVAC 20 assembly operates as a condenser. The system 10 further includes an indoor HVAC assembly 30 that operates as an evaporator to distribute conditioned air within a structure. The illustrated example shows the indoor HVAC assembly 30 as a furnace/cased coil combination. However, it will be appreciated that the indoor HVAC assembly 30 may also be a fan coil to name one non-limiting example.

The indoor HVAC assembly 30 includes an indoor heat exchanger (coil) 40, a blower 45, and evaporator drain lines 70. The indoor heat exchanger 40 may be formed from a microchannel heat exchanger or a round tube plate fin heat exchanger and may be configured as a slab coil as shown, an A-coil configuration or other configuration. The indoor heat exchanger 40 is disposed over a drain pan 50, which may also be referred to as a condensate receptor, and configured to collect condensate from the indoor heat exchanger 40.

With the requirements to move to lower GWP refrigerants it is likely that mildly flammable refrigerants, referred to in the art as "A2L refrigerants", will be used. A direct method to detect leaks is a refrigerant sensor. The sensors are required to be located inside the unit by safety standards like UL603335-2-40. The sensors are intended to detect leaks when the unit is off and then enable the fan to circulate the air and dilute the refrigerant below concentrations that are flammable. During normal operation when the fan is on it is not possible to get a leak large enough to reach a flammable concentration. But when the unit is off and there is a leak the refrigerant can run slowly drain out of the units and into the return duct work. If the ductwork is short then the refrigerant could reach an occupied space where there might be an ignition source. In some application the unit can be installed in a horizontal configuration or in a down discharge configuration so refrigerant can also leak out of the supply duct so this patent expands to cover adding a damper to the supply duct.

Figure 3:
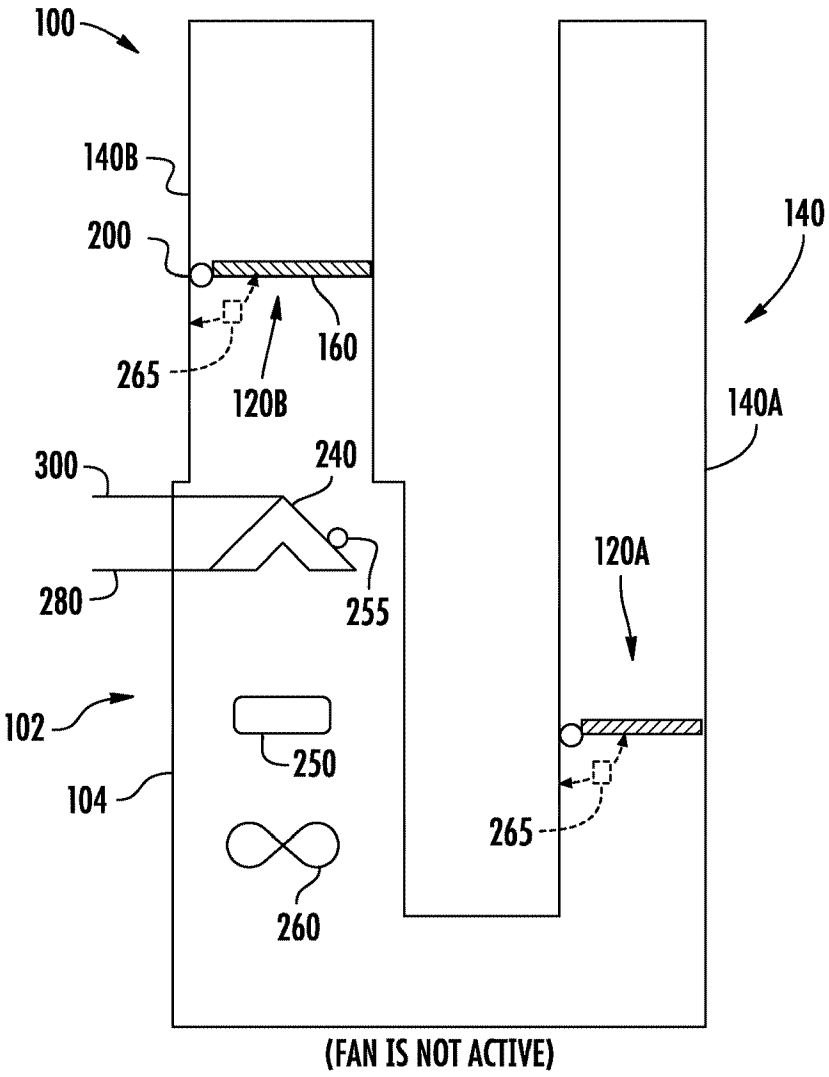
FIG. 3 shows an evaporator with leak mitigation dampers in an closed state, when a refrigerant leak is detected.
Figure 2:
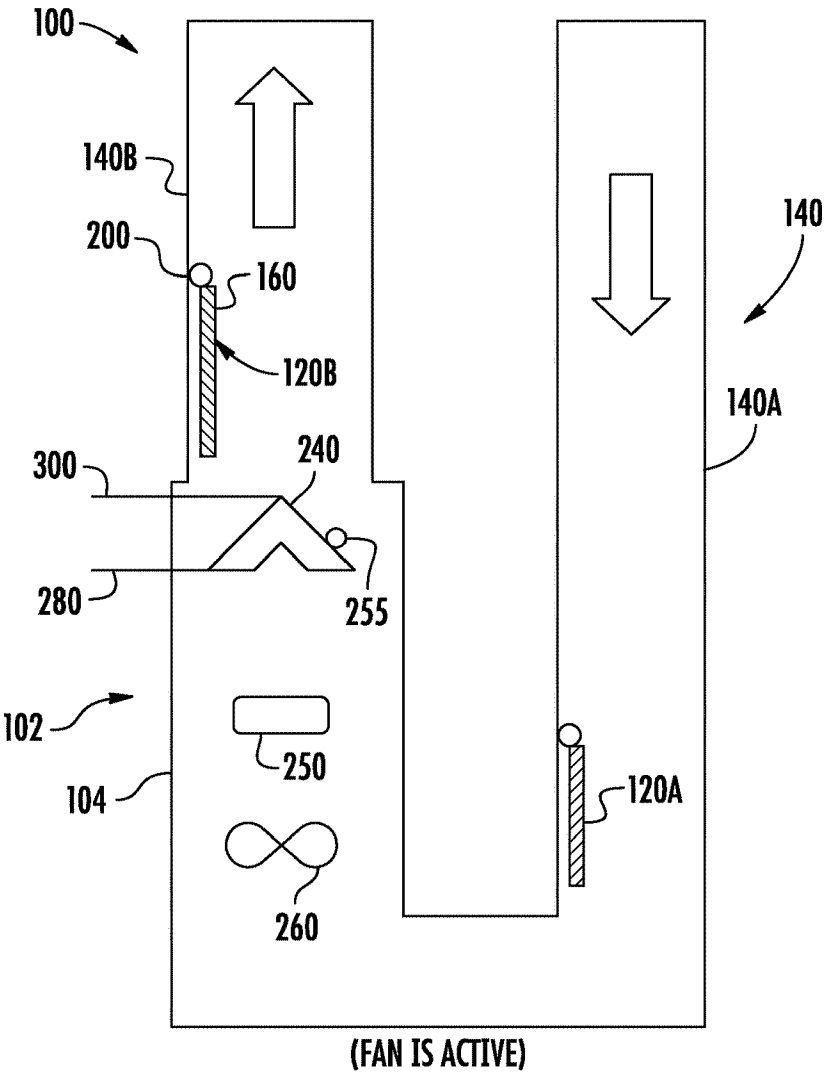
FIG. 2 shows an evaporator with leak mitigation dampers in an opened state, when no refrigerant leak is detected.

FIGS. 2 and 3 illustrate a schematic diagram of an embodiment of a heating, ventilation, air conditioning, and refrigeration (HVAC/R) system in an embodiment of the present disclosure, indicated generally as system 100. The system 100 includes a system component which may be an evaporator 102. Except as otherwise indicated in FIGS. 3 and 4 and disclosed herein, the system 100 and evaporator 102 are the same as the system 10 and evaporator 30 disclosed in FIG. 1.

The system 100 includes an evaporator housing 104 having a plurality of airflow conduits generally referred to as 140. A return conduit 140A receives a flow of return air to be cooled. A supply conduit 140B which may be a plenum, directs cooled air to a conditioned space. The system 100 includes a coil 240, illustrated as an A-coil, between the air conduits 140. The coil 240 may be a fan coil. The coil 240 includes a refrigerant supply line 280 and a refrigerant return line 300. A fan motor 260 is positioned between the coil 240 and the return conduit 140A.

According to an embodiment, a plurality of leak mitigation dampers 120 are provided. The plurality of leak mitigation dampers 120 are each disposed in one of the plurality of air conduits 140. Thus leak mitigation dampers 120 include a return side leak mitigation damper 120A and supply side leak mitigation damper 120B. According to embodiments, only a supply side leak mitigation damper or return side leak mitigation damper 120B may be provided depending on the length of supply and return ducts. The disclosure hereinafter shall focus on the supply side leak mitigation damper 120B though application of the disclosure may be applied to the return side leak mitigation damper 120A.

The supply side leak mitigation damper 120B may include a damper member 160 which may be a plate. A rotating component 200 is operably connected to the damper member 160. When the supply side leak mitigation damper 120B is in a closed position, the damper member 160 is positioned to block air through the supply air conduit 140B. This configuration occurs when a fan 260 within the evaporator 100 is not running. When the supply side leak mitigation damper 120B is in an opened position, the damper member 160 is positioned to allow airflow through the supply air conduit 140B. This configuration occurs wile the fan 260 is running. The system operates so that fan 260 does not run when a leak is occurring, thereby trapping leaked refrigerant within the system 100. That is, refrigerant cannot reach a flammable level when the fan 260 is on so the refrigerant is trapped inside the system 100 when the fan 260 is off. As indicated, airflow causes the dampers 120 to open.

The supply side leak mitigation damper 120B may be formed in any shape, and composed of any material suitable for blocking airflow, such as metal, plastic, wood, etc. to name a few non-limiting examples. The supply side leak mitigation damper 120B may pivot by action of a biasing feature 265 (illustrated schematically) which may be a spring or a weighted counterbalance so that the supply side leak mitigation damper 120B is closed when the fan 260 is off. In one embodiment the counterbalance is formed by an offset weight balance between the damper member 160 and the rotating component 200.

The dampers 120 are closed when every the fan 160 is off. This allows the refrigerant to concentrate and then the ability of the sensor 255 to detect is increased. This then turns on the fan 160 to mitigate. In the above embodiments, a controller 250, and a sensor 255 are in electrical communication with each other. The sensor 255 is configured to detect a refrigerant leak in the system 100. The dampers 120 cause the refrigerant to concentrate quickly and then the sensor 255 can detect even a relatively small leak and then the controller 250 turns on the fan 160. That is the dampers 120 are closed during off which time a leak can be detect and the dampers 120 allow the refrigerant to concentrate improving the response of the sensor 255. When a leak is detect the fan 260 comes on and dampers 120 are opened by the air velocity.

In normal operation to condition an interior space, a compressor 20 (FIG. 1) of the system 10 is fluidically coupled to the coil 240. Compressed refrigerant is configured to enter the coil 240 via a refrigerant supply line 280 and is configured to exit the coil 240 via a refrigerant return line 300. As the refrigerant flows through the coil 240, the fan motor 260 operates to circulate the conditioned air through the supply conduit 140B to an interior space (not shown). Return air from the interior space enters the evaporator 102 via the return conduit 140A. In an embodiment, the evaporator 102 may be combined with a furnace. In another embodiment, the evaporator 102 may be part of a refrigeration unit.

Figure 4:
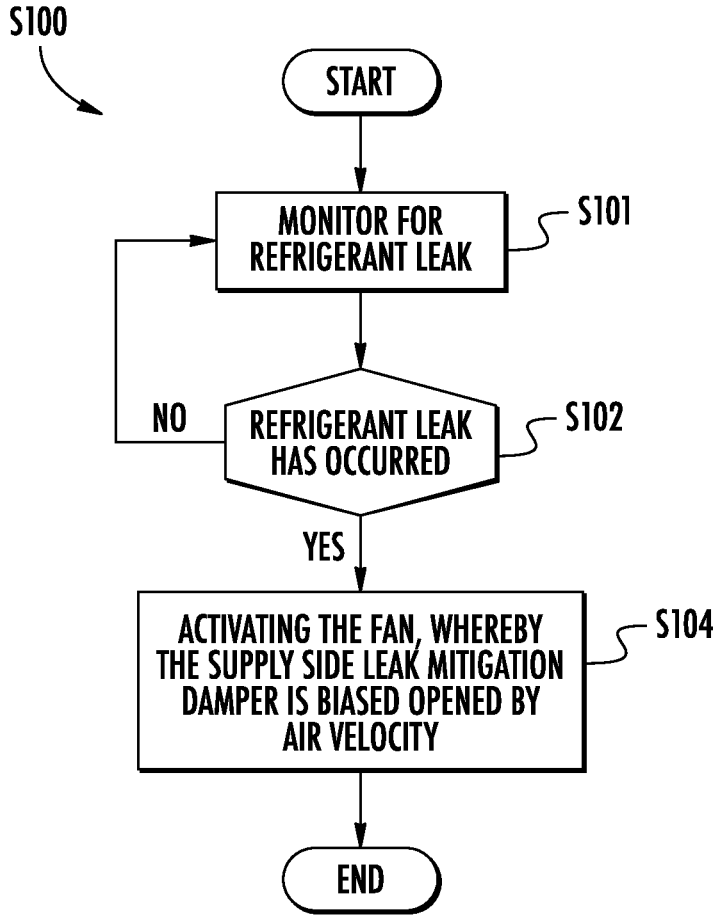
FIG. 4 is a flowchart showing a method of diluting a leaked refrigerant in an HVAC system according to an embodiment.

FIG. 4 illustrates a method of operating the system 100, the method generally indicated at S100. The method S100 includes step S101 of monitoring for a refrigerant leak while the fan 106 is inactive as indicated above. During this time, when the fan 106 is inactive, the dampers 120 are closed due to action of the biasing feature 265. Step S102 includes determining that a refrigerant leak has been detected. For example, the sensor 255 may be place within the system 100 or in near proximity to the system 100 to detect any instances where refrigerant may leak from the coil 240. The sensor 255 may detect refrigerant migration either outside the evaporator 102 or into one or both of the plurality of air conduits 140. Migration of the refrigerant may depend on the orientation of the evaporator 102. As indicated the refrigerant may be flammable and a concern during a leak is ignition may occur, where the source of ignition may come from either within or external to the evaporator 102.

If no leak is detected (NO at step S102), the system continues to monitor. If a leak occurs (YES at step S102) the method S100 further includes step S104 of activating the fan 264). From this, the supply side leak mitigation damper 120B is opened by air velocity. For example, once the sensor 255 has detected a refrigerant leak, an electrical signal may be transmitted to the fan 260. Upon receiving the electrical signal, the fan 260 transitions to an activated state. With a flow of air the supply side leak mitigation damper 120B transitions to an opened state. This mitigates the issue of a concentrated buildup of leaked refrigerant. That is, the system 100 monitors the leak when in an off state as when the fan 260 is on sufficient concentrations cannot be obtained. So when the system 100 is off the dampers 120 are closed and then if the sensor 255 trips the fan 260 is activated and the compressor 20 is prevented from running.

As described above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits. The disclosed embodiments enable the use of detecting a leak without direct measure of the refrigerant leaks.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An HVAC/R system comprising:

a controller;

a compressor that is operationally coupled to the controller;

an evaporator housing defining a supply side air conduit and a return side air conduit that are fluidly coupled to each other, wherein an upstream end of the return side air conduit defines an evaporator housing inlet and a downstream end of the supply side air conduit defines an evaporator housing outlet, wherein the housing is continuous between the housing inlet and the housing outlet, and wherein:

between the supply and return side air conduits, the housing includes:

a fan controlled by a fan motor that is operationally coupled to the controller;

an HVAC/R component that is a microchannel heat exchanger disposed over a drain pan, the HVAC/R component configured to allow a refrigerant to flow therethrough via operation of the compressor, wherein the heat exchanger is disposed between the fan and the supply side air conduit; and a refrigerant sensor that is adjacent to the heat exchanger and operationally coupled to the controller;

the supply side air conduit includes:

a supply side leak mitigation damper that is pivotally connected to the supply side air conduit and spring loaded to open when the fan motor is on and close and to block airflow through the supply side air conduit when the fan motor is off; and the return side air conduit includes:

a return side leak mitigation damper that is pivotally connected to the return side air conduit and spring loaded to open when the fan motor is on and close to block airflow through the return side air conduit when the fan motor is off, wherein, when the sensor senses leaked refrigerant, the controller is configured to prevent the compressor from running and turn on the fan motor, thereby opening the supply and return side leak mitigation dampers and directing air across the heat exchanger to dilute the leaked refrigerant.

2. The system of claim 1, wherein the HVAC/R component is operably coupled to a furnace.

3. The system of claim 1, wherein the HVAC/R component comprises a refrigeration unit.

4. A method of diluting a leaked refrigerant in the HVAC/R system of claim 1, the method comprising:

determining by the controller that the sensor senses that a refrigerant leak has occurred;

activating the fan to direct air across the heat exchanger, and thereby opening the supply side leak mitigation damper.

5. The method of claim 4, wherein:

the supply side leak mitigation damper is biased closed when the fan is inactive.

* * * * *